US006832192B2

(12) United States Patent
Yamada

(10) Patent No.: US 6,832,192 B2
(45) Date of Patent: Dec. 14, 2004

(54) SPEECH SYNTHESIZING METHOD AND APPARATUS

(75) Inventor: Masayuki Yamada, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 477 days.

(21) Appl. No.: 09/821,671

(22) Filed: Mar. 29, 2001

(65) Prior Publication Data

US 2001/0029454 A1 Oct. 11, 2001

(30) Foreign Application Priority Data

Mar. 31, 2000 (JP) ..... 2000-099531

(51) Int. Cl.[7] ..... G10L 13/06
(52) U.S. Cl. ..... 704/260; 704/267; 704/268
(58) Field of Search ..... 704/260, 267, 704/268, 208

(56) References Cited

U.S. PATENT DOCUMENTS 5,220,629 A * 6/1993 Kosaka et al. ..... 704/260
5,633,984 A 5/1997 Aso et al. ..... 704/260
5,845,047 A 12/1998 Fukada et al. ..... 704/268
6,499,014 B1 * 12/2002 Chihara ..... 704/260

FOREIGN PATENT DOCUMENTS

EP 1 093 111 A2 * 4/2001 ..... G10L/13/06

OTHER PUBLICATIONS

U.S. patent application Ser. No. 09/301,674, filed Mar. 5, 1999.
U.S. patent application Ser. No. 09/301,669, filed Mar. 5, 1999.
U.S. patent application Ser. No. 09/301,760, filed Mar. 9, 1999.

* cited by examiner

*Primary Examiner*—Susan McFadden
(74) *Attorney, Agent, or Firm*—Milbank, Tweed, Hadley & McCloy LLP

(57) ABSTRACT

A speech synthesizing apparatus acquires a synthesis unit speech segment divided as a speech synthesis unit, and acquires partial speech segments by dividing the synthesis unit speech segment with a phoneme boundary. The power value required for each partial speech segment is estimated on the basis of a target power value in reproduction. An amplitude magnification is acquired from the ratio of the estimated power value to the reference power value for each of the partial speech segments. Synthesized speech is generated by changing the amplitude of each partial speech segment of the synthesis unit speech segment on the basis of the acquired amplitude magnification.

21 Claims, 11 Drawing Sheets

FIG. 3

| FACTOR NAME | PHONEME TYPE | MORA COUNT | ACCENT TYPE | MORA POSITION | . . . |
|---|---|---|---|---|---|
| VALUE | /i/ | 5 | 2 | 3 | . . . |

FIG. 4

| SPEECH SEGMENT ID | 0 | | | 1 | | | ・・・ |
|---|---|---|---|---|---|---|---|
| PARTIAL SPEECH SEGMENT NUMBER | 0 | 1 | 2 | 0 | 1 | 2 | ・・・ |
| VOICED/ UNVOICED FLAG | NO | YES | NO | NO | YES | YES | ・・・ |

FIG. 5

| FACTOR NAME | PHONEME TYPE | | | MORA COUNT | | | ACCENT TYPE | | | MORA POSITION | | | · · · |
|---|---|---|---|---|---|---|---|---|---|---|---|---|---|
| FACTOR | /a/ | /i/ | · · · | 1 | 2 | · · · | 0 | 1 | · · · | 1 | 2 | · · · | · · · |
| COEFFICIENT | 21730 | 10492 | · · · | −1320 | −4174 | · · · | 236 | −10 | · · · | 8121 | 5230 | · · · | · · · |

FIG. 6

| FACTOR NAME | PHONEME TYPE | | | MORA COUNT | | | ACCENT TYPE | | | MORA POSITION | | | ・・・ |
|---|---|---|---|---|---|---|---|---|---|---|---|---|---|
| FACTOR | /t/ | /k/ | ・・・ | 1 | 2 | ・・・ | 0 | 1 | ・・・ | 1 | 2 | ・・・ | ・・・ |
| COEFFICIENT | 1030 | 985 | ・・・ | −20 | −45 | ・・・ | −4 | −17 | ・・・ | 945 | 753 | ・・・ | ・・・ |

FIG. 9A IN KANA
| | | |
|---|---|---|
| タ | カ | イ |
FIG. 9B SPEECH WAVEFORM
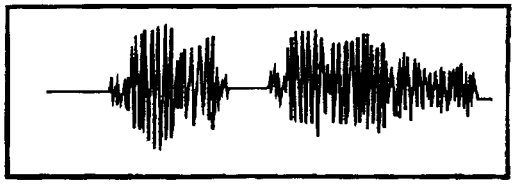
FIG. 9C PHONEME
| | | | | |
|---|---|---|---|---|
| /t/ | /a/ | /k/ | /a/ | /i/ |
FIG. 9D VOICED/ UNVOICED DETERMINATION RESULT
| | | | | |
|---|---|---|---|---|
| U | V | U | V | V |
FIG. 9E PHONEME POWER (REFERENCE VALUE)
| | | | | |
|---|---|---|---|---|
| 893 | 21473 | 1204 | 34820 | 17201 |
FIG. 9F PARTIAL SPEECH SEGMENT
| | | | | | | | | | | |
|---|---|---|---|---|---|---|---|---|---|---|
| | | | | | | | | | | |
FIG. 9G CV・VC
| | | | | | |
|---|---|---|---|---|---|
| —.t | t.a | a.k | k.a | a.i | i.— |

FIG. 10A IN KANA

| | | |
|---|---|---|
| タ | カ | イ |

FIG. 10B PHONEME

| | | | | |
|---|---|---|---|---|
| /t/ | /a/ | /k/ | /a/ | /i/ |

FIG. 10C CV・VC

| | | | | | |
|---|---|---|---|---|---|
| —.t | t.a | a.k | k.a | a.i | i.— |

FIG. 10D VCV

| | | |
|---|---|---|
| —.t.a | a.k.a | a.i— |

SPEECH SYNTHESIZING METHOD AND APPARATUS

FIELD OF THE INVENTION

The present invention relates to a speech synthesizing method and apparatus and, more particularly, to power control on synthesized speech in a speech synthesizing process.

BACKGROUND OF THE INVENTION

As a speech synthesizing method of obtaining desired synthesized speech, a method of generating synthesized speech by editing and concatenating speech segments in units of phonemes or CV/VC, VCV (C: Consonant; V: vowel), and the like is known. FIGS. 10A to 10D are views for explaining CV/VC and VCV as speech segment units. As shown in FIGS. 10A to 10D, CV/VC is a unit with a speech segment boundary set in each phoneme, and VCV is a unit with a speech segment boundary set in a vowel.

FIGS. 11A to 11D are views schematically showing an example of a method of changing the duration length and fundamental frequency of one speech segment. As shown in FIG. 11C, a speech waveform 1101 of one speech segment shown in FIG. 11A is divided into a plurality of small speech segments 1103 by a plurality of window functions 1102 in FIG. 11B. In this case, for a voiced sound portion (a voiced sound region in the second half of a speech waveform), a window function having a time width synchronous with the pitch of the original speech is used. For an unvoiced sound portion (an unvoiced sound region in the first half of the speech waveform), a window function having an appropriate time width (longer than that for a voiced sound portion) is used.

By repeating a plurality of small speech segments obtained in this manner, thinning out some of them, and changing the intervals, the duration length and fundamental frequency of synthesized speech 1104 can be changed as shown in FIG. 11D. For example, the duration length of synthesized speech can be reduced by thinning out small speech segments, and can be increased by repeating small speech segments. The fundamental frequency of synthesized speech can be increased by reducing the intervals between small speech segments of a voiced sound portion, and can be decreased by increasing the intervals between the small speech segments. By superimposing a plurality of small speech segments obtained by such repetition, thinning out, and interval changes, synthesized speech having a desired duration length and fundamental frequency can be obtained.

Power control for such synthesized speech can be performed as follows. Synthesized speech having a desired average power can be obtained by obtaining an estimated value $p_0$ of the average power of speech segments (corresponding to a target average power) and an average power p of the synthesized speech obtained by the above procedure, and multiplying the synthesized speech obtained by the above procedure by $(p/p_0)^{1/2}$. That is, power control is executed in units of speech segments.

The above power control method suffers the following problems.

The first problem is associated with mismatching between a power control unit and a speech segment unit.

To perform stable power control, power control must be performed in units of periods of time with a certain length. In addition, a power variation needs to be small within a power control unit. As a unit that satisfies these conditions, a phoneme or the like may be used. However, the above unit like CV/VC or VCV has a phoneme boundary with a large variation within a speech segment, and hence the power variation is large in each speech segment. Therefore, this unit is not suitable as a power control unit.

A voiced sound portion greatly differs in power from an unvoiced sound portion. Basically, since a voiced/unvoiced sound can be uniquely determined from a phoneme type, the above difference poses no problem if the average power value of each type of phoneme is estimated. A close examination, however, reveals that there are exceptions to the relationship between phoneme types and voice/unvoiced sounds, and mismatching may occur. In addition, a phoneme boundary may differ from a voiced/unvoiced sound boundary by several msec to ten-odd msec. This is because a phoneme type and phoneme boundary are mainly determined by a vocal tract shape, whereas a voiced/unvoiced sound is determined by the presence/absence of vocal cord vibrations.

SUMMARY OF THE INVENTION

The present invention has been made in consideration of the above problems, and has as its object to perform proper power control even if a phoneme unit with power greatly varying within a speech segment is set as a unit for waveform edition.

In order to achieve the above object, according to the present invention, there is provided a speech synthesizing method comprising the division step of acquiring partial speech segments by dividing a speech segment in a predetermined unit with a phoneme boundary, the estimation step of estimating a power value of each partial speech segment obtained in the division step on the basis of a target power value, the changing step of changing the power value of each of the partial speech segments on the basis of the power value estimated in the estimation step, and the generating step of generating synthesized speech by using the partial speech segments changed in the changing step.

In order to achieve the above object, according to the present invention, there is provided a speech synthesizing apparatus comprising division means for acquiring partial speech segments by dividing a speech segment in a predetermined unit with a phoneme boundary, estimation means for estimating a power value of each partial speech segment obtained by the division means on the basis of a target power value, changing means for changing the power value of each of the partial speech segments on the basis of the power value estimated by the estimation means, and the generating means for generating synthesized speech by using the partial speech segments changed by the changing means.

Preferably, in changing the power value of each of the partial speech segments, for each of the partial speech segments, a corresponding reference power value is acquired, an amplitude change magnification is calculated on the basis of the power value estimated in the estimation step and the acquired reference power value, and a change to the estimated power value is made by changing an amplitude of the partial speech segment in accordance with the calculated amplitude change magnification. More specifically, an amplitude value of the partial speech segment is changed by using, as an amplitude change magnification, s being obtained by $$s=(p/q)^{1/2}$$

where p is the power value estimated in the estimation step, and q is the acquired reference power value.

Preferably, in estimating the power of each partial speech segment, whether each of the partial speech segments is a voiced or unvoiced sound is determined, and if it is determined that the partial speech segment is a voiced sound, a power value is estimated by using a parameter value for a voiced speech segment, and if it is determined that the speech segment is an unvoiced sound, a power value is estimated by using a parameter value of an unvoiced speech segment. Since parameter values suited for voiced and unvoiced sounds are used, power control can be performed more properly.

Preferably, in estimating the power value of each partial speech segment, a power estimation factor for each of the partial speech segments is acquired, and a parameter value corresponding to the acquired power estimation factor is acquired in accordance with the determination result on a voiced/unvoiced sound to estimate the power value. Preferably, the power estimation factor includes one of a phoneme type of the partial speech segment, a mora position of a synthesis target word of the partial speech segment, a mora count of the synthesis target word, and an accent type.

Preferably, a power estimation factor for a voiced sound is acquired if it is determined that the partial speech segment is a voiced sound, and a power estimation factor for an unvoiced sound is acquired if it is determined that the partial speech segment is an unvoiced sound. Since different power estimation factors can be used depending on whether a partial speech segment is a voiced or unvoiced sound, power control can be performed more properly.

Preferably, the amplitude of each partial speech segment is changed on the basis of the estimated power value and the acquired reference power value, and the reference power value corresponding to a partial speech segment of an unvoiced sound is set to relatively large. Since the amplitude magnification of a partial speech segment as an unvoiced sound can be relatively reduced, power control can be realized while high sound quality is maintained.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 3 is a view showing examples of factors necessary for power estimation for a partial speech segment;

FIG. 4 is a view showing an example of the data arrangement of a table which is looked up to determine whether a partial speech segment is a voiced or unvoiced speech segment;

FIG. 5 is a view showing an example of a quantization category I coefficient table learnt for voiced power estimation;

FIG. 6 is a view showing an example of a quantization category I coefficient table learnt for unvoiced power estimation;

FIGS. 9A to 9G are views for explaining how a speech segment dictionary is generated in accordance with the flow chart of FIG. 8;

FIGS. 10A to 10D are views for explaining CV/VC and VCV as speech segment units.

DETAILED DESCRIPTION OF THE PREFERRED EMBODIMENTS

Preferred embodiments of the present invention will now be described in detail in accordance with the accompanying drawings.

[First Embodiment]

Figure 1:
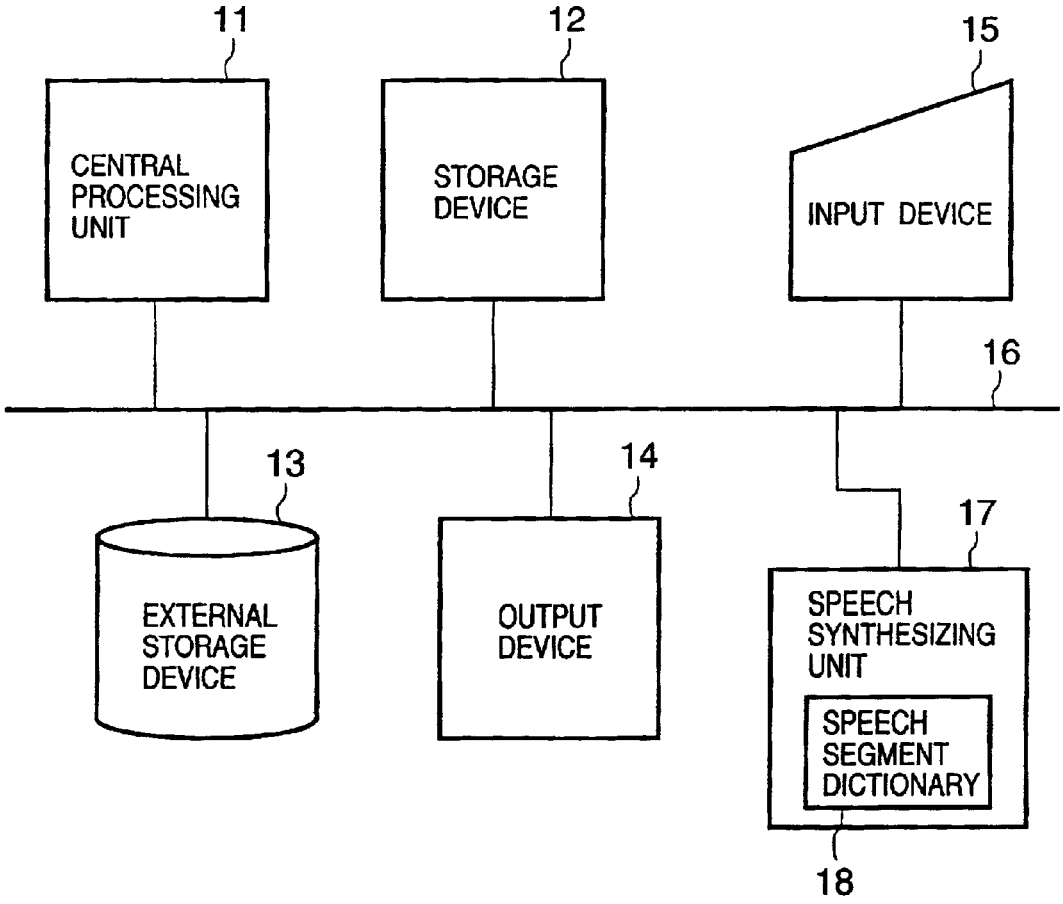
FIG. 1 is a block diagram showing the hardware arrangement of a speech synthesizing apparatus according to the first embodiment.

FIG. 1 is a block diagram showing the hardware arrangement of a speech synthesizing apparatus according to this embodiment. Referring to FIG. 1, reference numeral 11 denotes a central processing unit for performing processing such as numeric operation and control, which realizes control to be described later with reference to the flow chart of FIG. 2; 12, a storage device including a RAM, ROM, and the like, in which a control program required to make the central processing unit 11 realize the control described later with reference to the flow chart of FIG. 2 and temporary data are stored; and 13, an external storage device such as a disk device storing a control program for controlling speech synthesis processing in this embodiment and a control program for controlling a graphical user interface for receiving operation by a user.

Reference numeral 14 denotes an output device including a speaker and the like, from which synthesized speech is output. The graphical user interface for receiving operation by the user is displayed on a display device. This graphical user interface is controlled by the central processing unit 11. Note that the present invention can also be applied to another apparatus or program to output synthesized speech. In this case, an output is an input for this apparatus or program.

Reference numeral 15 denotes an input device such as a keyboard, which converts user operation into a predetermined control command and supplies it to the central processing unit 11. The central processing unit 11 designates a text (in Japanese or another language) as speech synthesis target, and supplies it to a speech synthesizing unit 17. Note that the present invention can also be incorporated as part of another apparatus or program. In this case, input operation is indirectly performed through another apparatus or program.

Reference numeral 16 denotes an internal bus, which connects the above components shown in FIG. 1; and 17, a speech synthesizing unit for synthesizing speech from an input text by using a speech segment dictionary 18. Note that the speech segment dictionary 18 may be stored in the external storage device 13.

The operation of the speech synthesizing unit 17 according to this embodiment which has the above hardware arrangement will be described below.

Figure 2:
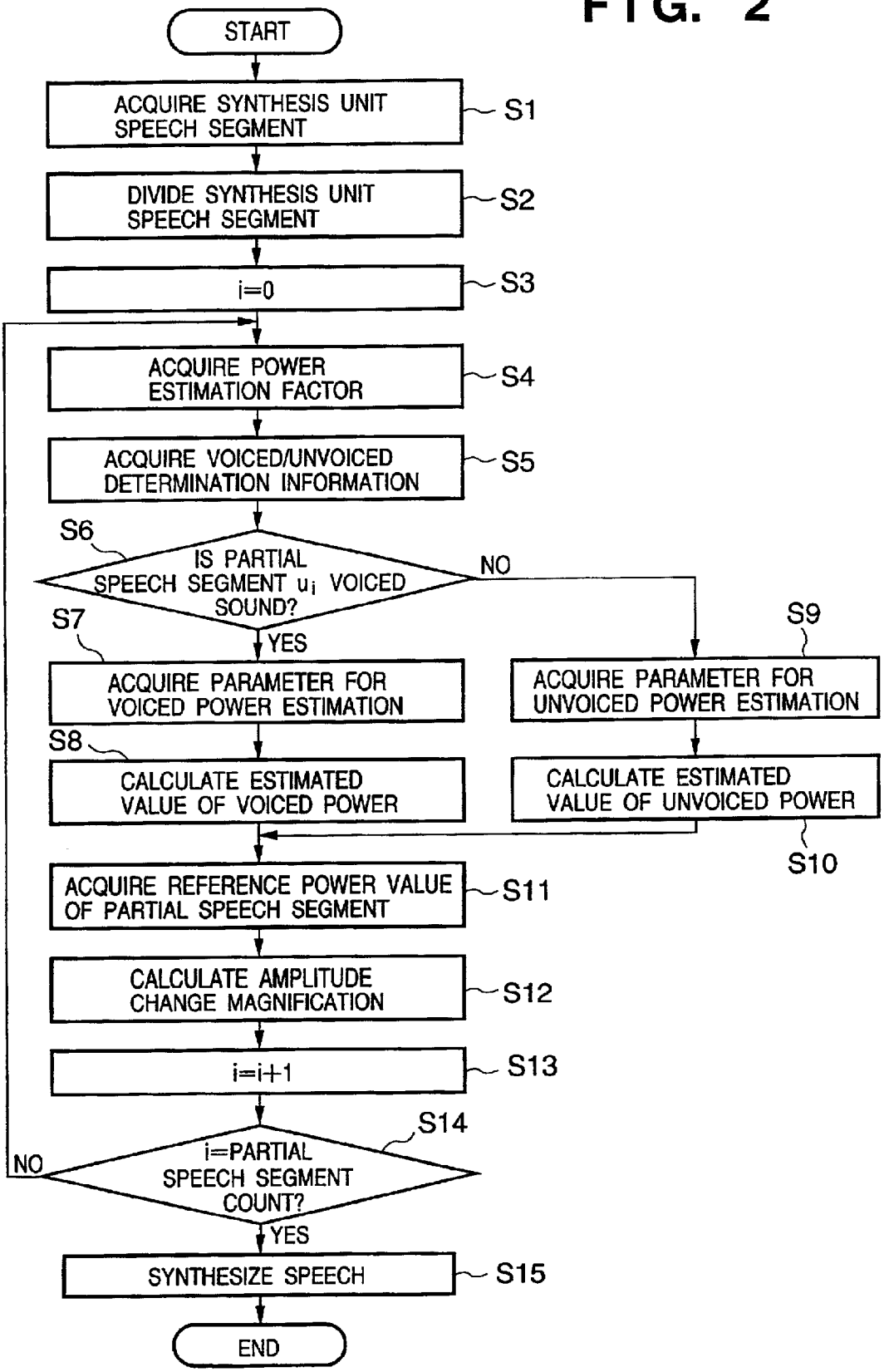
FIG. 2 is a flow chart showing a procedure for speech synthesis processing in this embodiment.

FIG. 2 is a flow chart showing the procedure executed by the speech synthesizing unit 17 in this embodiment. In step S1, the speech synthesizing unit 17 performs language analysis and acoustic processing for an input text to generate a phoneme series representing the text and linguistic information (mora count, mora position, accent type, and the like) of the phoneme series. The speech synthesizing unit 17 then reads out from the speech segment dictionary 18 speech waveform data (to be also referred to as synthesis unit speech segment) representing a speech segment corresponding to one synthesis unit. In this case, a synthesis unit is a unit including a phoneme boundary such as CV/VC or VCV. In step S2, the speech segment acquired in step S1 is divided by using phoneme boundaries as boundaries. The speech segments acquired by division processing in step S2 will be referred to as partial speech segments $u_i$. If, for example, the speech segment is VCV, it is divided into three partial speech segments. If the speech segment is CV/VC, it is divided into two partial speech segments. In step S3, a loop counter i is initialized to 0.

In step S4, estimation factors required to estimate the power of the partial speech segment $u_i$ are acquired. In this case, as shown in FIG. 3, the phoneme type of the partial speech segment $u_i$, the accent type and mora count of a synthesis target language, the position of the partial speech segment $u_i$ in the synthesis target language (corresponding to the mora position), and the like are used as estimation factors. These estimation factors are contained in the linguistic information obtained in step S1. In step S5, the speech synthesizing unit 17 acquires information (FIG. 4) for determining whether the partial speech segment $u_i$ is a voiced speech segment or unvoiced speech segment. That is, a voiced/unvoiced sound flag is acquired from a speech segment ID corresponding to the speech segment acquired in step S1 and a partial speech segment number (corresponding to the loop counter i) of the speech segment. The information shown in FIG. 4 is stored in the speech segment dictionary 18.

In step S6, it is checked on the basis of the voiced/unvoiced sound flag obtained in step S5 whether the partial speech segment $u_i$ is a voiced or unvoiced speech segment. If it is determined in step S6 that the partial speech segment $u_i$ is a voiced speech segment, the flow advances to step S7. If the partial speech segment $u_i$ is an unvoiced speech segment, the flow advances to step S9.

In step S7, parameter values for voiced sound power estimation are acquired on the basis of the respective estimation factors obtained in step S4. If, for example, estimation based on quantization category I is to be performed, parameter values corresponding to the estimation factors obtained in step S4 are acquired from a quantization category I coefficient table (FIG. 5) learnt for voiced sound power estimation. In step S8, power $p_i$ as synthesized speech target is estimated on the basis of the parameter values obtained in step S7. The flow then advances to step S11. The information shown in FIG. 5 is stored in the speech segment dictionary 18.

According to quantization category I, an estimated value is represented by the linear sum of coefficients corresponding to estimation factors. Consider a case where an estimated power value x of the second phoneme, /a/, of the word "yama" (/y/, /a/, /m/, /a/) with a mora count of 2 and accent type 0 is obtained in an utterance of the word. In this case, since the mora position of /a/ is first, according to the table in FIG. 5, $$x=21730-4174+236+8121$$

If it is determined that the partial speech segment $u_i$ is an unvoiced speech segment, parameters values for unvoiced sound power estimation are acquired in step S9 on the basis of the estimation factors obtained in step S4. If, for example, estimation based on quantization category I is to be performed, parameter values corresponding to the estimation factors obtained in step S4 are acquired from a quantization category I coefficient table (FIG. 6) learnt for unvoiced sound power estimation. In step S10, the power $p_i$ as a synthesized speech target is estimated on the basis of the parameters values obtained in step S9. The flow then advances to step S11. The information shown in FIG. 5 is stored in the speech segment dictionary 18.

In step S11, a reference power value $q_i$ corresponding to the partial speech segment $u_i$ stored in the speech segment dictionary 18 is acquired. In step S12, an amplitude change magnification $s_i$ is calculated from an estimated value $p_i$ estimated in step S8 or S10 and reference power value $q_i$ acquired in step S11. In this case, if both $p_i$ and $q_i$ are power dimension values, then $$s_i=(p_i/q_i)^{1/2}$$

In the above case, it is assumed that one waveform is registered in correspondence with each partial speech segment $u_i$. In this case, if, for example, there are the word "takai" (/t/, /a/, /k/, /a/, /i/) and the word "amai" (/a/, /m/, /a/, /i/), the waveform corresponding to one of the partial speech segments "a.i" and "i.-" is discarded. Obviously, a plurality of waveforms may exist for one partial speech segment $u_i$. In this case, since the reference values shown in FIG. 9E are prepared for the respective waveforms, IDs are assigned to the respective waveforms, and the reference values are registered in correspondence with the IDs. If, for example, there are two waveforms for the partial speech segments "a.i" and "i.-" in correspondence with the words "takai" and "amai", the corresponding IDs are assigned to them. In a speech synthesizing process, one of these waveforms is selectively used by a certain method, and hence the corresponding reference value is used.

In step S13, the value of the loop counter i is incremented by one. In step S14, it is checked whether the value of the loop counter i is equal to the total number of partial speech segments of one phoneme unit. If NO in step S14, the flow returns to step S4 to perform the above processing for the next partial speech segment. If the value of the loop counter i is equal to the total number of partial speech segments, the flow advances to step S15. In step S15, power control on each partial speech segment of each speech segment is performed by using the amplitude change magnification $s_i$ obtained in step S12. In addition, waveform editing operation is performed for each speech waveform by using other prosodic information (duration length and fundamental frequency). Furthermore, synthesized speech corresponding to the input text is obtained by concatenating these speech segments. This synthesized speech is output from the speaker of the output device 14. In step S15, waveform edition of each speech segment is performed by using PSOLA (Pitch-Synchronous Overlap Add method).

Note that the flow chart of FIG. 2 shows processing for one speech segment. Therefore, the processing in FIG. 2 is repeated the same number of times as the speech segments held by the text, thereby obtaining synthesized speech corresponding to the text. In this process, power values are determined in units of partial speech segments of each speech segment. In step S15, these partial speech segments are sequentially concatenated.

As described above, according to the first embodiment, a speech segment containing at least one speech segment boundary is divided into partial speech segments with the speech segment boundaries, and a power value can be estimated depending on whether each partial speech segment is a voiced or unvoiced sound. This makes it possible to perform appropriate power control even if a phoneme unit in which a power variation in a speech segment such as CV/VC or VCV increases as a unit of waveform edition, thereby generating high-quality synthesized speech.

[Second Embodiment]

Figure 7:
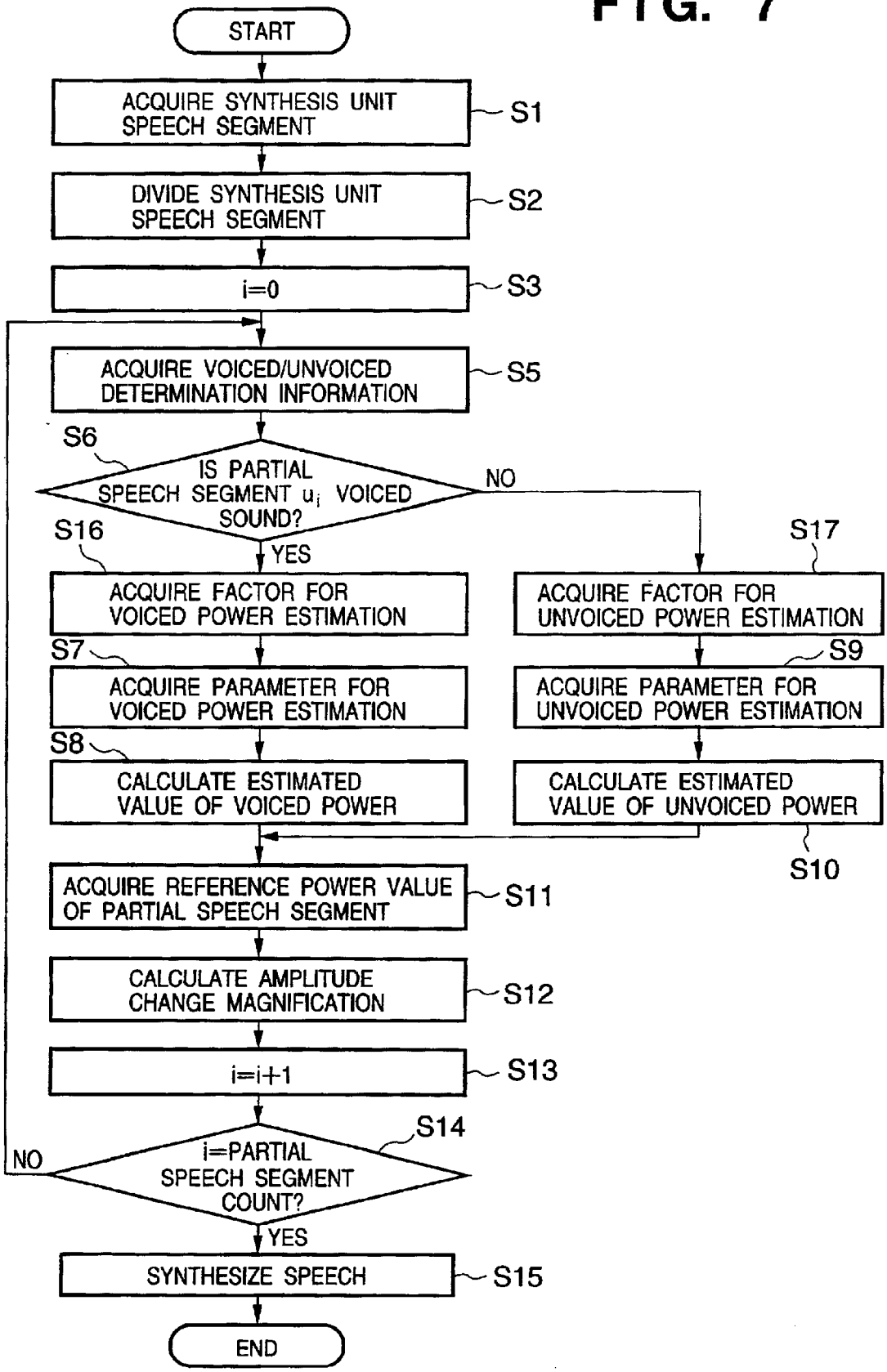
FIG. 7 is a flow chart for explaining a procedure for speech synthesis processing in the second embodiment.

The same factors as in the first embodiment are assumed for power estimation regardless of voiced/unvoiced speech. Common factors such as phoneme type, mora count, accent type, and mora position are used for power estimation from the tables shown in FIGS. 5 and 6. However, factors for power estimation may be selectively used depending on voiced/unvoiced speech. In the second embodiment, different factors are used for power estimation depending on voiced/unvoiced speech. FIG. 7 is a flow chart for explaining a procedure for speech synthesis processing in the second embodiment. The same step numbers as in the first embodiment (FIG. 2) denote the same steps in FIG. 7, and a description thereof will be omitted.

In the first embodiment, in step S4, the same factors for power estimation are acquired regardless of voiced/unvoiced speech. In the second embodiment, step S4 is omitted, and power estimation factors corresponding to voiced speech and unvoiced speech are acquired in steps S16 and S17. If it is determined in step S6 that a partial speech segment $u_i$ is a voiced speech segment, a power estimation factor for voiced speech is acquired in step S16. In step S7, a parameter value corresponding to this voiced speech is acquired from the table shown in FIG. 5. If it is determined in step S6 that the partial speech segment $u_i$ is unvoiced speech, an unvoiced power estimation factor is acquired in step S17. In step S9, a parameter value corresponding to this power estimation factor for the unvoiced speech is acquired from the table in FIG. 6.

As described above, according to the second embodiment, since parameters for power estimation are acquired by using factors suitable for voiced and unvoiced sound portions, power control can be performed more appropriately.

[Third Embodiment]

Figure 8:
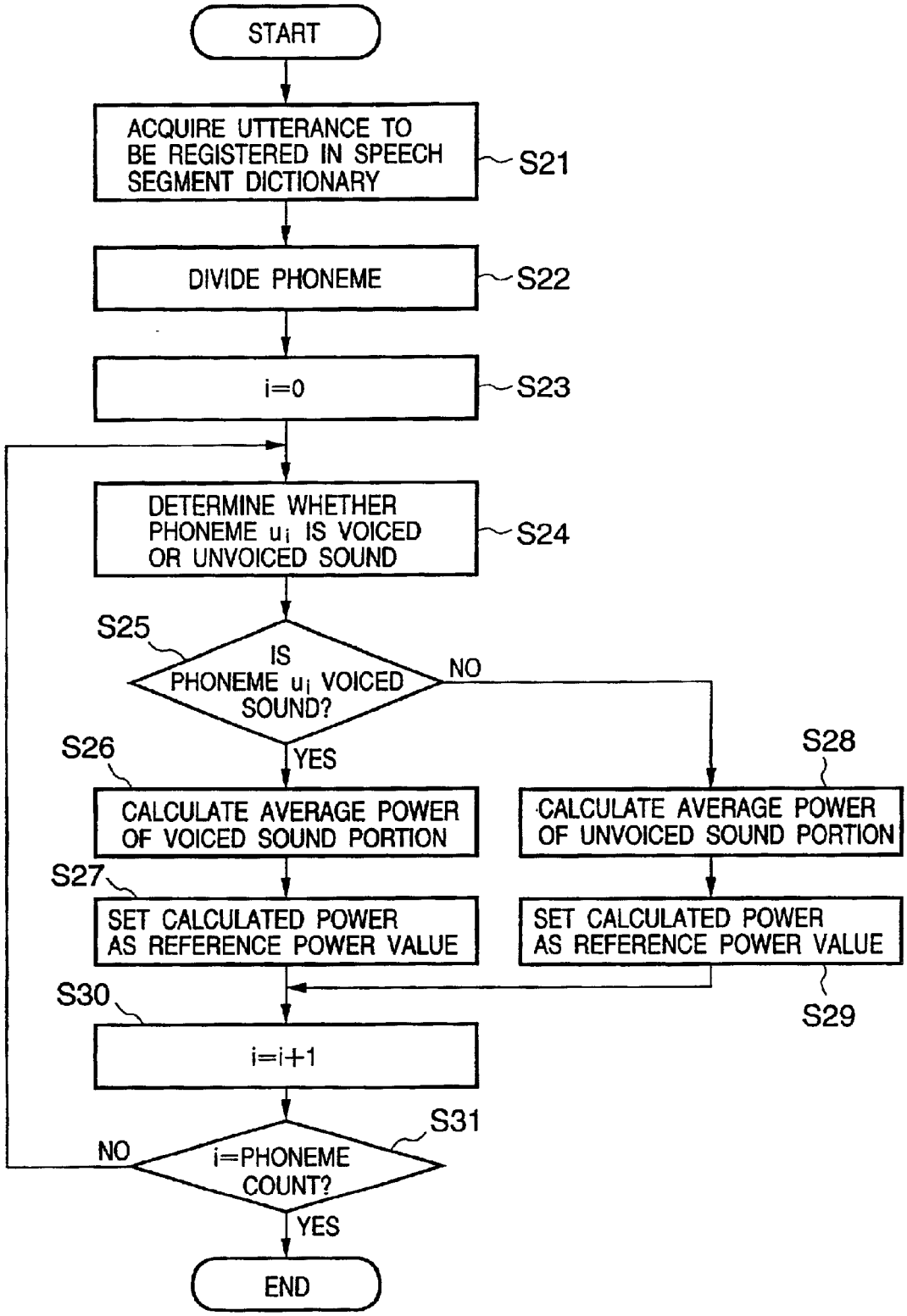
FIG. 8 is a flow chart for explaining a procedure for generating a speech segment dictionary in the third embodiment.
Figures 11A, 11B, 11C, 11D:
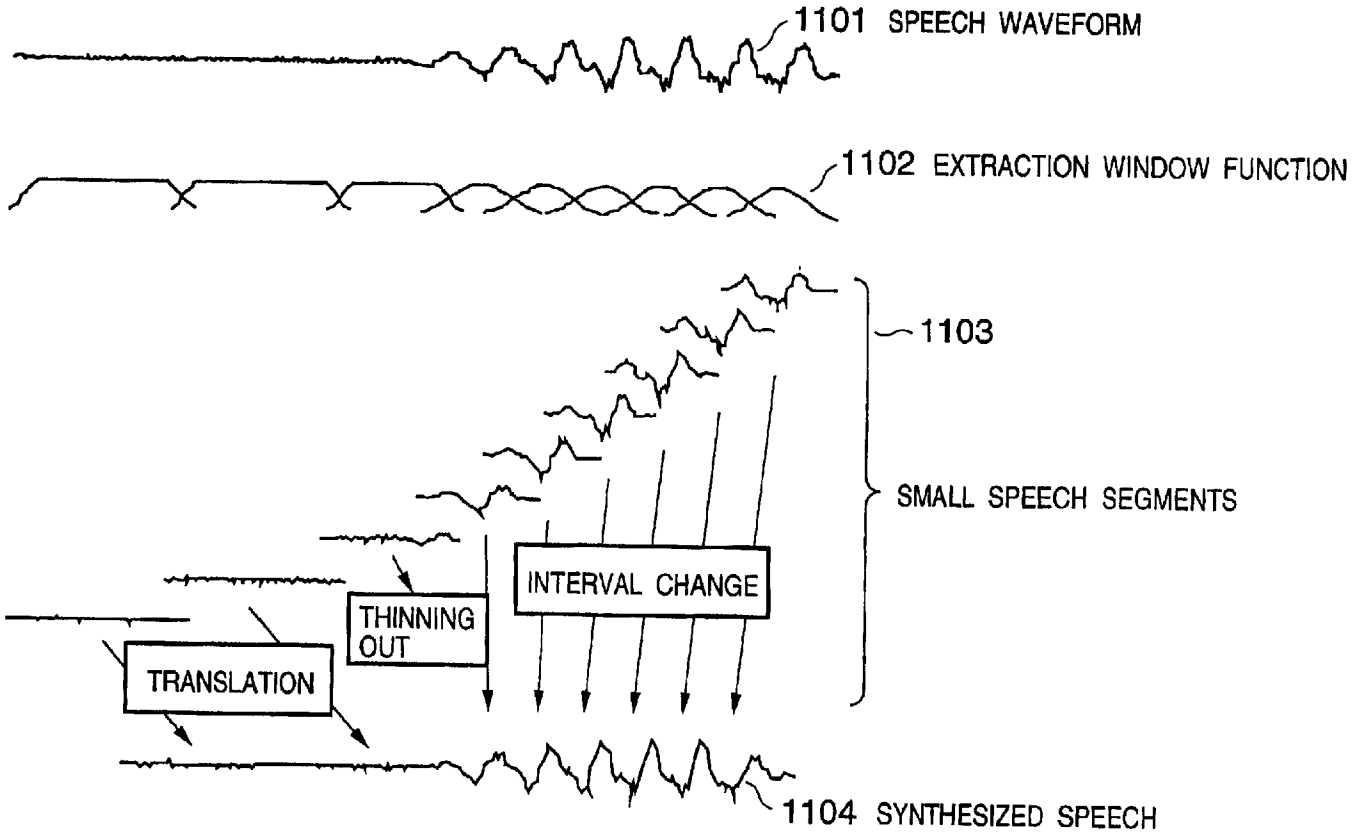
FIGS. 11A to 11D are views for schematically showing a method of dividing a speech waveform into small speech segments.

In the first and second embodiments, an arbitrary value can be used as a reference power value $q_i$ of a partial speech segment. Reference power values are essentially values associated with power. In a speech synthesizing process, however, only a table containing such values is looked up. Therefore, values different from power may be input. For example, a person may determine proper values while listening to synthesized speech and write them in the table as reference values. For example, phoneme power can be used as such reference power values. In this embodiment, speech segment dictionary generation processing with phoneme power being used as the reference power value $q_i$ of a partial speech segment will be described. FIG. 8 is a flow chart for explaining a procedure for speech segment dictionary generation processing in a speech synthesizing unit 17. FIGS. 9A to 9G are views for explaining the speech segment dictionary generation processing based on the flow chart of FIG. 8.

In step S21, an utterance (shown in FIGS. 9A and 9B) to be registered in a speech segment dictionary 18 is acquired. In step S22, the utterance acquired in step S21 is divided into phonemes (FIG. 9C). In step S23, a loop counter i is initialized into 0.

In step S24, it is checked whether an ith phoneme $u_i$ is a voiced or unvoiced sound. In step S25, a branch is caused depending on the determination result in step S24. If it is determined in step S24 that the phoneme $u_i$ is a voiced sound, the flow advances to step S26. If it is determined that the phoneme $u_i$ is an unvoiced sound, the flow advances to step S28.

In step S26, the average power of the voiced sound portion of the ith phoneme is calculated. In step S27, the average value of the voiced sound portion calculated in step S26 is set as a reference power value. The flow then advances to step S30. In step S28, the average power of the unvoiced sound portion of the ith phoneme is calculated. In step S29, the unvoiced sound portion average power calculated in step S28 is set as a reference power value. The flow then advances to step S30.

In step S30, the value of the loop counter i is incremented by one. It is checked in step S31 whether the value of the loop counter i is equal to the total number of phonemes. If NO in step S31, the flow returns to step S24 to repeat the above processing for the next phoneme. If it is determined in step S31 that the value of the loop counter i is equal to the total number of phonemes, this processing is terminated. With the above processing, it is checked whether each phoneme is a voiced/unvoiced sound as shown in FIG. 9D, and a phoneme reference power value is set as shown in FIG. 9E.

If, for example, a speech segment "t.a" as a CV/VC unit is divided into partial speech segments /t/ and /a/, "893" is used as a reference power value q of the partial speech segment "/t/", and "2473" as the reference power value q of the partial speech segment "/a/" (FIGS. 9E to 9G).

In the third embodiment, the value obtained by multiplying the average power of an unvoiced sound portion by a value larger than 1 is set as a reference power value in step S29. This makes it possible to obtain the effect of further suppressing the power of an unvoiced sound portion in speech synthesis. By setting a relatively large value as a reference value in this manner, the change magnification in step S12 is reduced.

The present invention can also be applied to a case wherein a storage medium storing software program codes for realizing the functions of the above-described embodiment is supplied to a system or apparatus, and the computer (or a CPU or an MPU) of the system or apparatus reads out and executes the program codes stored in the storage medium. In this case, the program codes read out from the storage medium realize the functions of the above-described embodiment by themselves, and the storage medium storing the program codes constitutes the present invention. The functions of the above-described embodiment are realized not only when the readout program codes are executed by the computer but also when the OS (Operating System) running on the computer performs part or all of actual processing on the basis of the instructions of the program codes.

The functions of the above-described embodiments are also realized when the program codes read out from the storage medium are written in the memory of a function expansion board inserted into the computer or a function expansion unit connected to the computer, and the CPU of the function expansion board or function expansion unit performs part or all of actual processing on the basis of the instructions of the program codes.

As has been described above, according to the present invention, even if a synthesis unit such as a CV/VC or VCV with power greatly varying within in a speech segment is set as a unit for waveform edition, proper power control can be performed, and hence high-quality synthesized speech can be generated.

As many apparently widely different embodiments of the present invention can be made without departing from the spirit and scope thereof, it is to be understood that the invention is not limited to the specific embodiments thereof except as defined in the claims.

What is claimed is:

1. A speech synthesizing method comprising:

the division step of acquiring partial speech segments by dividing a speech segment in a predetermined unit with a phoneme boundary;

the estimation step of estimating a power value of each partial speech segment obtained in the division step on the basis of a parameter value acquired for each partial speech segment independently;

the changing step of changing the power value of each of the partial speech segments on the basis of the power value estimated in the estimation step; and the generating step of generating synthesized speech by using the partial speech segments changed in the changing step.

2. The method according to claim 1, wherein in the changing step, for each of the partial speech segments, a corresponding reference power value is acquired based on the partial speech segment and the other portion of a speech segment to which the partial speech segment belongs, an amplitude change magnification is calculated on the basis of the power value estimated in the estimation step and the acquired reference power value, and a change to the estimated power value is made by changing an amplitude of the partial speech segment in accordance with the calculated amplitude change magnification.

3. The method according to claim 2, wherein in the changing step, an amplitude value of the partial speech segment is changed by using, as an amplitude change magnification, s being obtained by $$s=(p/q)^{1/2}$$

where p is the power value estimated in the estimation step, and q is the acquired reference power value.

4. The method according to claim 1, wherein the estimation step further comprises the determination step of determining whether each of the partial speech segments is a voiced or unvoiced sound, and if it is determined that the partial speech segment is a voiced sound, a power value is estimated by using a parameter value for a voiced speech segment, and if it is determined that the speech segment is an unvoiced sound, a power value is estimated by using a parameter value of an unvoiced speech segment.

5. The method according to claim 4, wherein the estimation step further comprises the acquisition step of acquiring a power estimation factor for each of the partial speech segments, and a parameter value corresponding to the acquired power estimation factor is acquired in accordance with a determination result obtained in the determination step.

6. The method according to claim 5, wherein the power estimation factor includes one of a phoneme type of the partial speech segment, a mora position of a synthesis target word of the partial speech segment, a mora count of the synthesis target word, and an accent type.

7. The method according to claim 5, wherein in the acquisition step, a power estimation factor for a voiced sound is acquired if it is determined in the determination step that the partial speech segment is a voiced sound, and a power estimation factor for an unvoiced sound is acquired if it is determined that the partial speech segment is an unvoiced sound.

8. The method according to claim 4, wherein in the change step, a reference power value of the partial speech segment is acquired, and an amplitude of the partial speech segment is changed on the basis of the power value estimated in the estimation step and the acquired reference power value, and the reference power value corresponding to a partial speech segment of an unvoiced sound is set to relatively large.

9. The method according to claim 1, wherein the speech synthesis unit is CV/VC.

10. The method according to claim 1, wherein the speech synthesis unit is VCV.

11. A speech synthesizing apparatus comprising:

division means for acquiring partial speech segments by dividing a speech segment in a predetermined unit with a phoneme boundary;

estimation means for estimating a power value of each partial speech segment obtained by said division means on the basis of a parameter value acquired for each partial speech segment independently;

changing means for changing the power value of each of the partial speech segments on the basis of the power value estimated by said estimation means; and the generating means for generating synthesized speech by using the partial speech segments changed by said changing means.

12. The apparatus according to claim 11, wherein said changing means, for each of the partial speech segments, acquires a corresponding reference power value speech segment and the other portion of a speech segment to which the partial speck segment belongs, calculates an amplitude change magnification on the basis of the power value estimated by said estimation means and the acquire reference power value, and makes a change to the estimated power value by changing an amplitude of the partial speech segment in accordance with the calculated amplitude change magnification.

13. The apparatus according to claim 12, wherein said changing means changes an amplitude value of the partial speech segment by using, as an amplitude change magnification, s being obtained by $$s=(p/q)^{1/2}$$

where p is the power value estimated by said estimation means, and q is the acquired reference power value.

14. The apparatus according to claim 11, wherein said estimation means further comprises determination means for determining whether each of the partial speech segments is a voiced or unvoiced sound, and if it is determined that the partial speech segment is a voiced sound, a power value is estimated by using a parameter value for a voiced speech segment, and if it is determined that the speech segment is an unvoiced sound, a power value is estimated by using a parameter value of an unvoiced speech segment.

15. The apparatus according to claim 14, wherein said estimation means further comprises acquisition means for acquiring a power estimation factor for each of the partial speech segments, and a parameter value corresponding to the acquired power estimation factor is acquired in accordance with a determination result obtained by said determination means.

16. The apparatus according to claim 15, wherein the power estimation factor includes one of a phoneme type of the partial speech segment, a mora position of a synthesis target word of the partial speech segment, a mora count of the synthesis target word, and an accent type.

17. The apparatus according to claim 15, wherein said acquisition means acquires a power estimation factor for a voiced sound if it is determined by said determination means that the partial speech segment is a voiced sound, and acquires a power estimation factor for an unvoiced sound if it is determined that the partial speech segment is an unvoiced sound.

18. The apparatus according to claim 14, wherein said change means acquires a reference power value of the partial speech segment, and changes an amplitude of the partial speech segment on the basis of the power value estimated by said estimation means and the acquired reference power value, and the reference power value corresponding to a partial speech segment of an unvoiced sound is set to relatively large.

19. The apparatus according to claim 11, wherein the speech synthesis unit is CV/VC.

20. The apparatus according to claim 11, wherein the speech synthesis unit is VCV.

21. A storage medium storing a control program for making a computer implement the method defined in claim 1.

* * * * *

UNITED STATES PATENT AND TRADEMARK OFFICE

CERTIFICATE OF CORRECTION

PATENT NO. : 6,832,192 B2
DATED : December 14, 2004
INVENTOR(S) : Masayuki Yamada It is certified that error appears in the above-identified patent and that said Letters Patent is hereby corrected as shown below:

Column 5,
Line 63, the formula should appear as follows: -- x=21730-4174+236+8121… --

Column 10,
Line 31, "power value speech" should read -- power value based on the partial speech --

Signed and Sealed this

Tenth Day of May, 2005

JON W. DUDAS
*Director of the United States Patent and Trademark Office*